United States Patent [19]

Eriksson

[11] 4,210,352

[45] Jul. 1, 1980

[54] HOISTING APPARATUS

[75] Inventor: Göran Eriksson, Gävle, Sweden

[73] Assignee: Jack Roland, Gävle, Sweden

[21] Appl. No.: 944,617

[22] Filed: Sep. 21, 1978

[30] Foreign Application Priority Data

Sep. 28, 1977 [SE] Sweden ..... 7710827
Feb. 27, 1978 [SE] Sweden ..... 7802186

[51] Int. Cl.[2] ..... B66C 17/04
[52] U.S. Cl. ..... 294/81 R
[58] Field of Search ..... 294/81 R, 81 SF, 67 R, 294/67 B, 67 BA, 67 BB, 67 BC, 67 DA, 74, 88, 106, 87; 214/114, 658, 730

[56] References Cited

U.S. PATENT DOCUMENTS 3,297,353 1/1967 Carlson ..... 294/81 R
3,397,907 8/1968 Trowbridge ..... 294/81 R
3,532,376 10/1970 Munck ..... 294/81 R

*Primary Examiner*—James B. Marbert
*Attorney, Agent, or Firm*—Charles E. Brown

[57] ABSTRACT

This invention relates to an apparatus for hoisting loads, such as pulp bales (2), particularly from a wharf into the hold of a ship and vice versa. The apparatus has a number of gripping devices (33) which, by means of a control mechanism, are automatically put into either an operative or an inoperative condition. According to the invention each gripping device has one or more gripping claws (37) which are arranged on one and the same level relative to a holder (4) for the device irrespective of whether the gripping claw is kept in the operative position or is remote from said position.

18 Claims, 9 Drawing Figures

HOISTING APPARATUS

This invention relates to a hoisting apparatus of the type comprising a gripping device associated with a holder, said gripping device being movable relative to the holder between an operative position and an inoperative position, and a carrier, which is movable relative to the holder towards a position remote from the holder as well as securable—by means of a control mechanism—relative to the holder in a position closer thereto than the first-mentioned position, said carrier being connected to the gripping device through at least one pull member which in a tensioned condition—when the carrier is a unsecured and movable relative to the holder—forces the gripping device to assume a first one of said two positions thereof and in a tensionless condition—when the carrier is secured relative to the holder—permits the gripping device to assume the second one of said two positions thereof.

A hoisting apparatus of the above-mentioned general art is previously known by the German patent publication No. 2,111,565. In this apparatus the gripping device in question is composed of a plurality of foot-like plates which are pivotable in the horizontal plane about vertical axes so as to engage steel bands surrounding the load which is to be hoisted by means of the apparatus. However, this construction of the gripping device makes it necessary to use special permanent magnets for lifting up the steel bands before the gripping plates can be pivoted and moved in under the bands in question. The need of these permanent magnets for lifting the steel bands and securing engagement with the gripping plates makes the operation of the entire apparatus most unreliable and complicated and therefore this apparatus has not been appreciably used in practice.

The object of the present invention is to obviate the inconveniences of the prior construction and provide a hoisting apparatus which is reliable and easily operated as well as universally usable. According to the invention this is achieved by the fact that the gripping device comprises an arm which is provided with a gripping claw and rotatable between said operative position and said inoperative position about an axis which is associated with the holder through a connection permitting raising and lowering of said axis relative to the holder so as to locate the gripping claw substantially on one and the same level at the bottom of the holder irrespective of whether the gripping claw is kept in the operative position by action of the pull member or is remote from said position.

With reference to the attached drawing a closer description of two embodiments of the invention will follow hereinafter.

The hoisting apparatus of the invention is advantageously used in connection with the handling of pulp bales which are carried for instance from a wharf down into the hold of a ship. Such bales mainly have a parallelpipedic form and they are surrounded by a band or a number of wires which may be gripped by the gripping device of the hoisting apparatus so that the bale or bales follow the hoisting apparatus when this is raised and lowered. In the hold the bales are stowed close to each other in order to maximally utilize the holding capacity of the ship.

Figure 1:
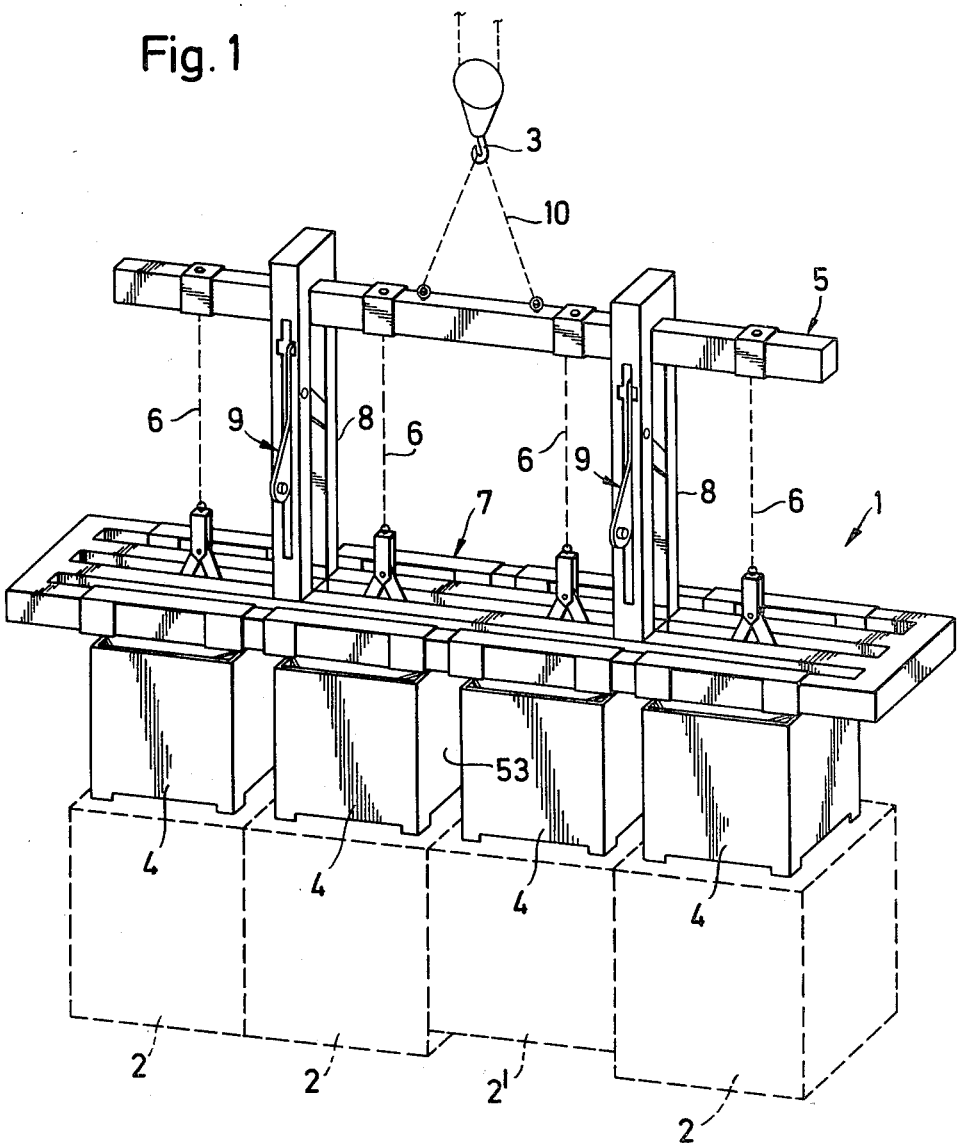
FIG. 1 is a perspective view of a first embodiment of the apparatus of the invention during hoisting of the load in question, the apparatus being shown in its entirety.

In FIG. 1 the reference numeral 1 generally designates a hoisting apparatus of the invention. Under apparatus 1 a number of pulp bales 2 are shown in dashed lines. These bales may be either simple bales or so called big bales (each of which is composed of a plurality of simple bales). As indicated by bale 2' the bales may be of somewhat different sizes and be gripped by the hoisting apparatus in spite of this fact. Apparatus 1 is suspended in a lifting hook 3 which may be elevated and moved laterally in an arbitrary manner, for instance by means of a crane, which, traverser or the like.

Figure 2:
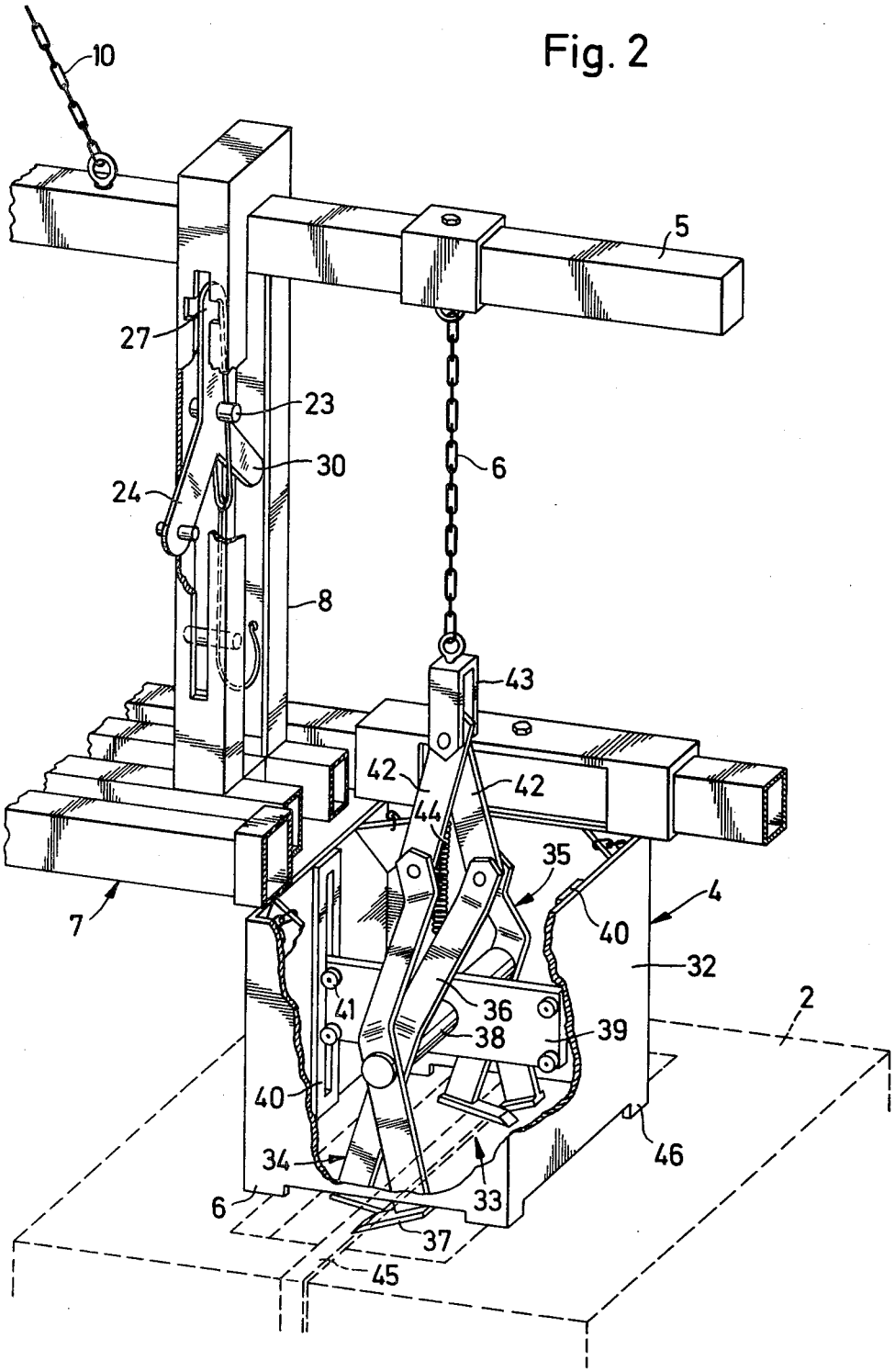
FIG. 2 is an enlarged perspective view showing only part of the apparatus with the gripping device in an operative position, certain portions of the components forming the apparatus being cut away for the sake of clarity.
Figure 3:
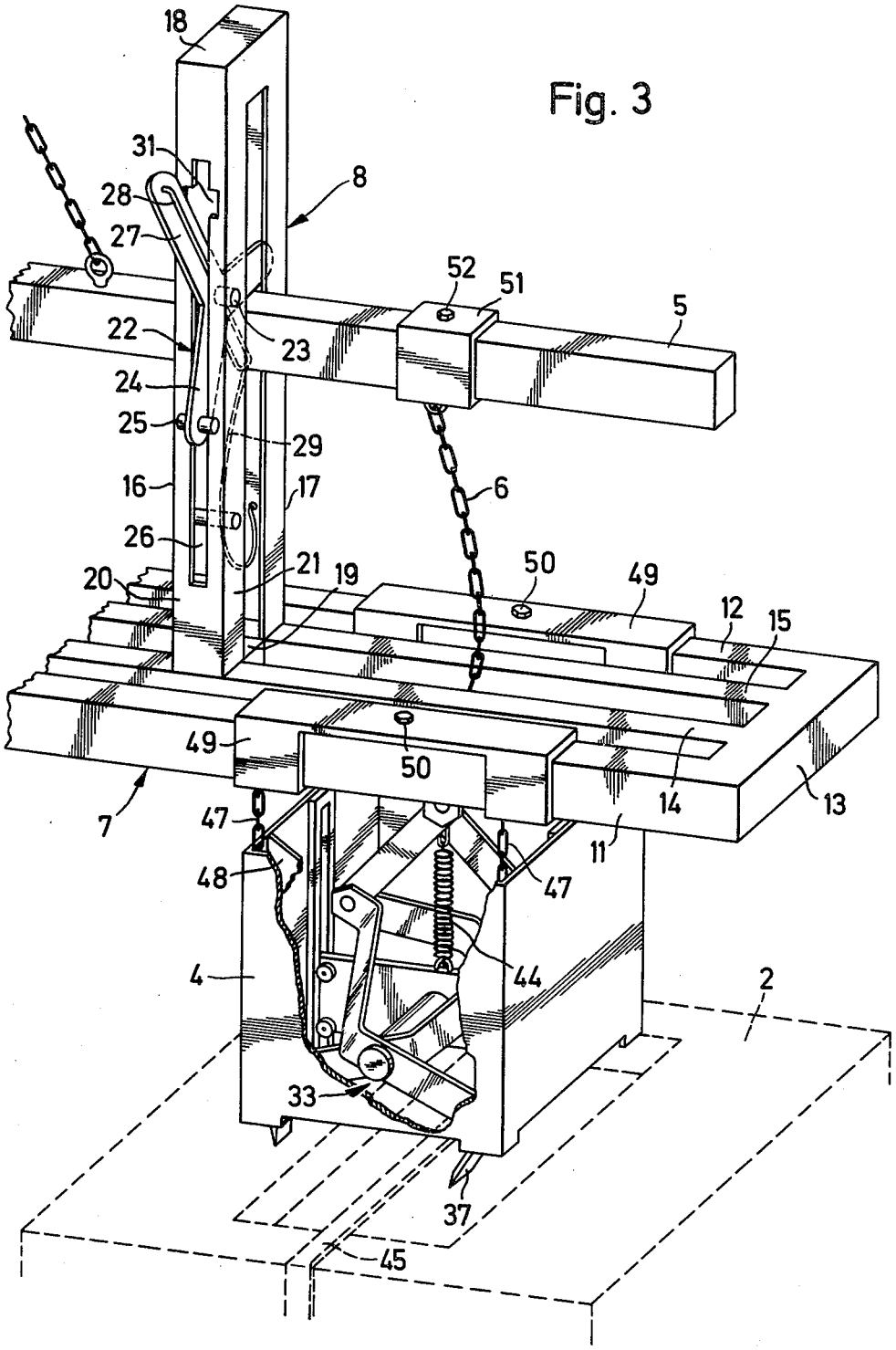
FIG. 3 is a similar perspective view illustrating the gripping device in an inoperative position.
Figure 4:
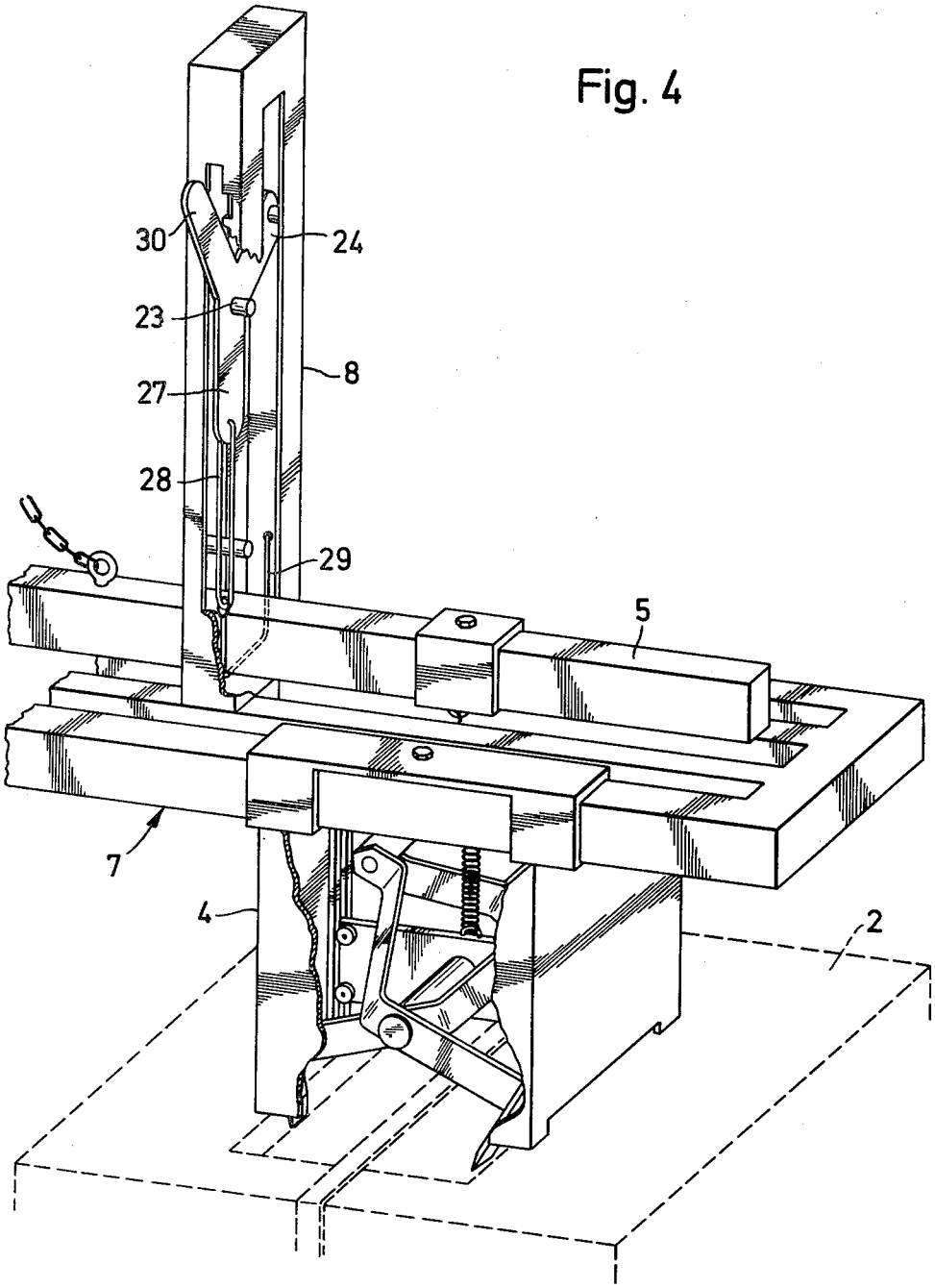
FIG. 4 is an additional similar perspective view showing the apparatus during adjustment of the gripping device from the inoperative position to the operative position.

In the specific embodiment shown, the apparatus comprises four holders 4 for gripping devices, the design of which will appear better from FIGS. 2 to 4. The apparatus comprises a first carrier 5 which is movable relative to the holders 4 as well as securable in a certain position in relation to these. Carrier 5 is connected to the gripping devices through pull members 6 which in a tensioned condition—when said carrier is unsecured and movable relative to the holders—forces the gripping devices to a first one of the two positions thereof, and in a tensionless condition—when said carrier is secured relative to the holders—permits the gripping devices to assume the second one of the two positions thereof. The apparatus further comprises a second carrier 7, which is connected to the holders 4 but not to the gripping devices and which has two substantially upright guides 8 along which the first carrier 5 is movable. Each of said guides 8 comprises a control mechanism 9 arranged to hold, on a first occasion, the first carrier on a first level relative to the guide, where the pull members 6 are tensionless, and, on a second occasion, release the same in order to move it to a second, higher level relative to the guides (see FIG. 1), where the pull members are tensioned.

In this embodiment first carrier 5 consists of a long horizontal bar which is provided with suitable means 10 for suspending the same in the lifting hook 3. Second carrier 7 consists of a horizontal frame from which the guides 8 project upwardly.

Reference is now made to FIGS. 2 to 4 which illustrate the various units comprised in the apparatus in detail.

As appears from FIG. 3 frame 7 comprises two parallel spaced-apart outer longitudinal beams 11, 12 which at their ends are interconnected by means of cross-beams 13, only one of which is visible in the drawing. These cross-bars are in turn connected to two inner longitudinal beams 14, 15 which are spaced from the outer beams 11, 12 and on which the guides 8 are supported.

Each individual guide 8 comprises two spaced-apart uprights 16, 17 which are interconnected by a top end piece 18 defining the upper level or the end position of bar 5. At the bottom a stiffening piece 19 is disposed between inner beams 14, 15. Uprights 16, 17 consist of U-beams which conventionally have a rib 20 and two opposite side flanges 21.

In the very embodiment shown in FIGS. 1 to 4 the control mechanism 9 comprises an Y-shaped body designated 22 which is rotatable about a pin 23 extending between the flanges 21 of U-beam 16. This Y-body 22 has a first shank 24 presenting a cross-pin 25 arranged to co-operate with a stop on upright 16. A vertical slot 26 is cut out in rib 20 for accommodating the Y-body 22, said stop for the pin 25 being formed by the two rib portions surrounding slot 26. A second shank 27 of the Y-body is heavier than the first shank 24. Through a rigid yoke 28 extending beyond pin 23, said second shank is connected to one end of a line 29, the opposite end of which is attached to the second upright 17 at a certain level above the lower part thereof. Finally the Y-body comprises a third free shank 30 which is as heavy as the first shank 24. An opening 31 in the rib 20 permits the pin 25 to pass through the rib in question. In FIG. 3 Y-body 22 is in a position in which bar 5 is secured and in FIG. 4 in a bar releasing position. The function of this type of control mechanism will be described later.

The individual holder 4 (see FIG. 2) comprises a collar-like body built up by four upright interconnected plates 32. The gripping device (generally designated 33) disposed in holder 4 comprises two spaced-apart pairs 34, 35 of arms 36, each of which has a gripping claw or part 37 at the bottom thereof. Each arm 36 is rotatable between an operative position and an inoperative position about an axis or shaft 38, which in turn is connected to holder 4 through a cross-bar 39, the opposed ends of which are guided by vertical guides 40 attached to the inside of two opposite plates 32 of the holder. This cross-bar 39, the movements of which along the guides 40 may be facilitated by a number of rollers 41, is advantageously made from a relatively heavy metal piece, which by its own weight tends to move the shaft 38 as well as the gripping arms associated therewith downwards as soon as the pull member 6 becomes tensionless. In a manner shown per se, arms 36 are connected through links 42 to a schackle 43 at the lower part of pull member 6. It is to be noted that each individual link 42 is common to two analogous arms in the two arm pairs 34, 35. It should also be noted that each arm is bent so as to be connected to the central link thereof in spite of the fact that the arm is connected to shaft 38 at an end thereof. Advantageously a spring 44 may be provided between pull member 6 or schackle 43 on one hand and shaft 38 or cross bar 39 on the other, said spring aiming at bringing the shaft and the pull member closer to each other, thereby, through links 42, rotating arms 36 in such a direction that the gripping claws 37 are separated from each other. It should be noted that the gripping claw 37 of each pair of gripping arms are facing each other in order to jointly grip a band 45 surrounding bale 2 as indicated in FIG. 2.

The lower edges of holder plates 23 are recessed along a central portion while forming four feet 46 located at the corners of the holder. By these recesses one eliminates the risk of tilting the holder in such a manner that an appropriate gripping of band 45 would be jeopardized.

By the fact that shaft 38, on which the gripping arms 36 are mounted in the above-mentioned way, is connected to holder 4 through the cross-bar 39, which permits raising and lowering of the shaft relative to the holder, it is guaranteed that the gripping claws 37 are kept substantially on one and the same level at the bottom of the holder irrespective of whether the gripping claws are in the operative position or in the inoperative position.

Each holder 4 (see FIG. 3) is connected to frame 7 through flexible chains 47 which permit at least a certain lateral movability between the holder and the frame. These chains 47 are attached to fasteners accommodated in corner boxes 48 which simply consist of inclined plates disposed at the upper corners of the holder 4, each box being able of properly accommodating a chain in the tensionless condition thereof. At the top chains 47 are attached to cages 49 which are adjustable into different positions along outer beams 11, 12 and fixable there by means of screws 50. It should be noted that these cages 49 are movable between arbitrary positions along the outer beams notwithstanding the existance of guides 8, because a gap is always present between the outer beams 11, 12 and the inner beams 14, 15. In a similar manner pull members 6 are movable to and fixable in different positions along the bar, in that said members are suspended in cages 51 which surround the bar and are fixable relative to this by means of screws 52.

In the drawings a chain 6 is shown as a pull member. It is however possible to use other types of pull members as well, for instance cables, lines, wires or the like. It is even possible to use two telescoping tubes and/or rods which are provided with suitable stops making it possible for the elements to be tensioned in the fully extended condition.

From FIG. 1 appears how the various holders 4 are arranged with spaces or gaps 53 therebetween. Thanks to these gaps in combination with the flexible suspending of the holders through the elements 47 an automatic butting of the bales 2 against each other is achieved when the hoisting apparatus is raised. This is of great importance in that the bales in practice are often placed at some distance from each other.

Figure 5:
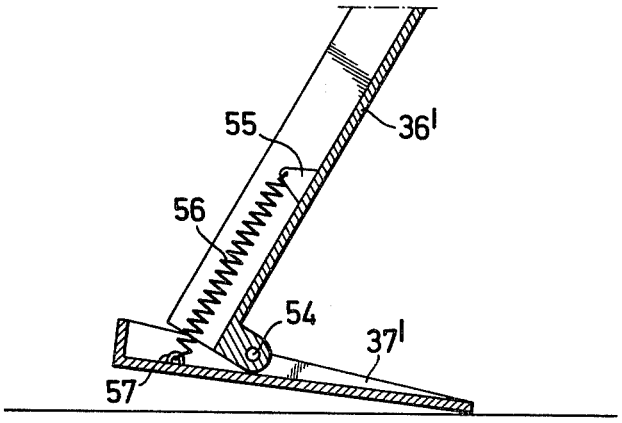
FIGS. 5 and 6 are sections showing certain alternative details of the gripping device.
Figure 6:
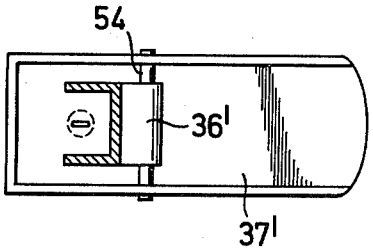

Reference is now made to FIGS. 5 and 6 illustrating an alternative embodiment of the claws of the gripping device. Here, gripping arm 36 consists of a U-beam which at the bottom has a pivot pin 54 to which gripping claw 37' is pivotally connected. One end of a draw spring 56 is attached to a first bracket 55, the opposite end of said spring being attached to a second bracket 57 on the gripping claw 37'. Due to the fact that gripping claw 37' is in this manner pivotally connected to arm 36' a very careful contact of the gripping claw against the upper side of the load is achieved. This is extremely advantageous in such cases where the load is wrapped in a material, e.g. plastics, being damageable by tearing.

The apparatus thus described operates in the following manner.

In FIGS. 1 and 2 the apparatus is shown during lifting of the load in question. Here bar 5 is located in its upper end position relative to the guides 8, with the Y-body of the control mechanism 9 adjusted in such a way that the first and third shanks 24, 30 thereof point downwardly from pivot pin 23 and the second shank 27 points upwardly. The lifting force between each bale 2 and the bar 5 is in proper order transmitted through: band 45, gripping claws 37, arms 36, links 42, schackle 43 and chain 6 which accordingly is stretched or tensioned. It should be noted that frame 7 is carried freely suspending from bar 5 through the yoke-like guides 8 and that holders 4 rest on bales 2 while chain elements 47 are slack.

When the load is put down on the intended place the following takes place. As soon as the bales 2 have come in contact with the ground and the lifting hook 3 is continuously lowered, frame 7 will be supported by at least some of the holders 4 resting on the bales. Continued lowering of lifting hook 3 and consequently bar 5 will bring about that chains 6 are slacked so that the cross-bar 39 by the weight thereof causes shaft 38 and consequently arms 36 to move downwardly relative to the holder and at the same time the arms are, with the aid of spring 44, brought to rotate in a direction towards a separation of the gripping claws 37 from each other, and thereby the gripping action of said claws around the bands 45 ceases. During its downward movement bar 5 passes control mechanism 9 notwithstanding the presence of the third shank 30 which simply pivots away and back to the position shown in FIG. 2.

As soon as bar 5 has passed the third shank 30 it is lifted again and now Y-body 22 prevents the bar from moving past shank 30 since the first shank 24 is now pivoted so that stop pin 25 is applied against the rib portions surrounding slot 26. Upon continued lifting of bar 5 the holders 4 will accordingly, through chain elements 47, be supported by frame 7 which in turn is carried by bar 5 through Y-body 22. From FIG. 3 clearly appears that pull member 6 is simultaneously slacked and that the gripping claws 37 are separated from each other while assuming an inoperative position.

When the apparatus is put down on the next load to be lifted, as illustrated in FIG. 4, the frame 7 will rest on the holders 4 which in turn are standing on the respective bale. Now, in order to adjust Y-body 22, bar 5 is lowered to the bottom position of FIG. 4 in which the line 29 is stretched; a manoeuvre resulting in that the Y-body is rotated half a turn so that the second shank 27 points downwardly while the first and the third shanks 24, 30 point upwardly. In this position Y-body 22 is balanced by the fact that shanks 24, 30 have the same weight, while shank 27 is somewhat heavier than these. When bar 5 is once again lifted, first shank 24 is pivoted away so that the Y-body returns to the position shown in FIG. 2. At the same time pull member 6 is tensioned and also at the same time arms 36 are pivoted so that gripping claws 37 engage bands 45. The procedure may now be repeated.

Figure 7:
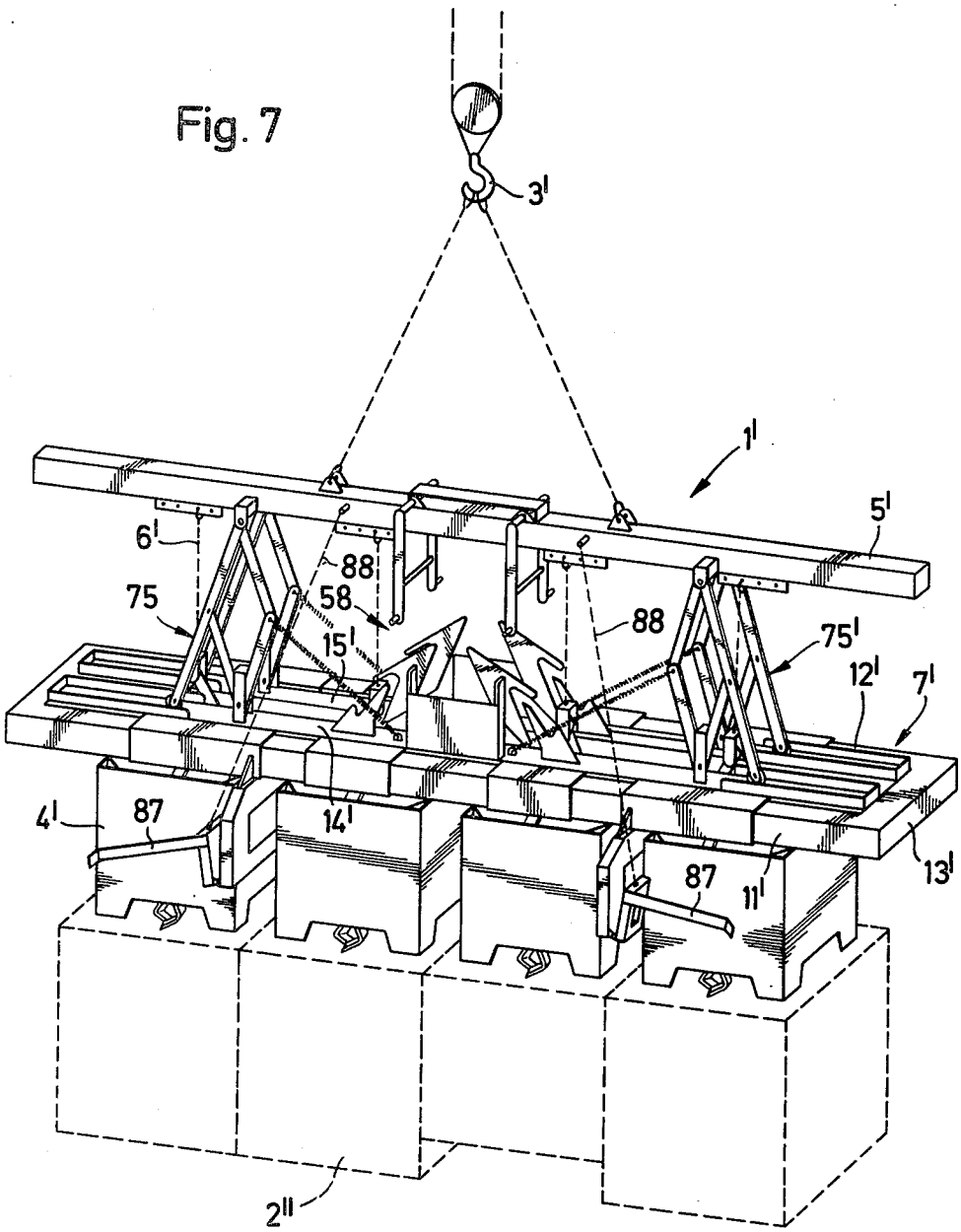
FIG. 7 is a perspective total view of the apparatus provided with an alternative preferred control mechanism, the apparatus being shown during hoisting of the load.
Figure 8:
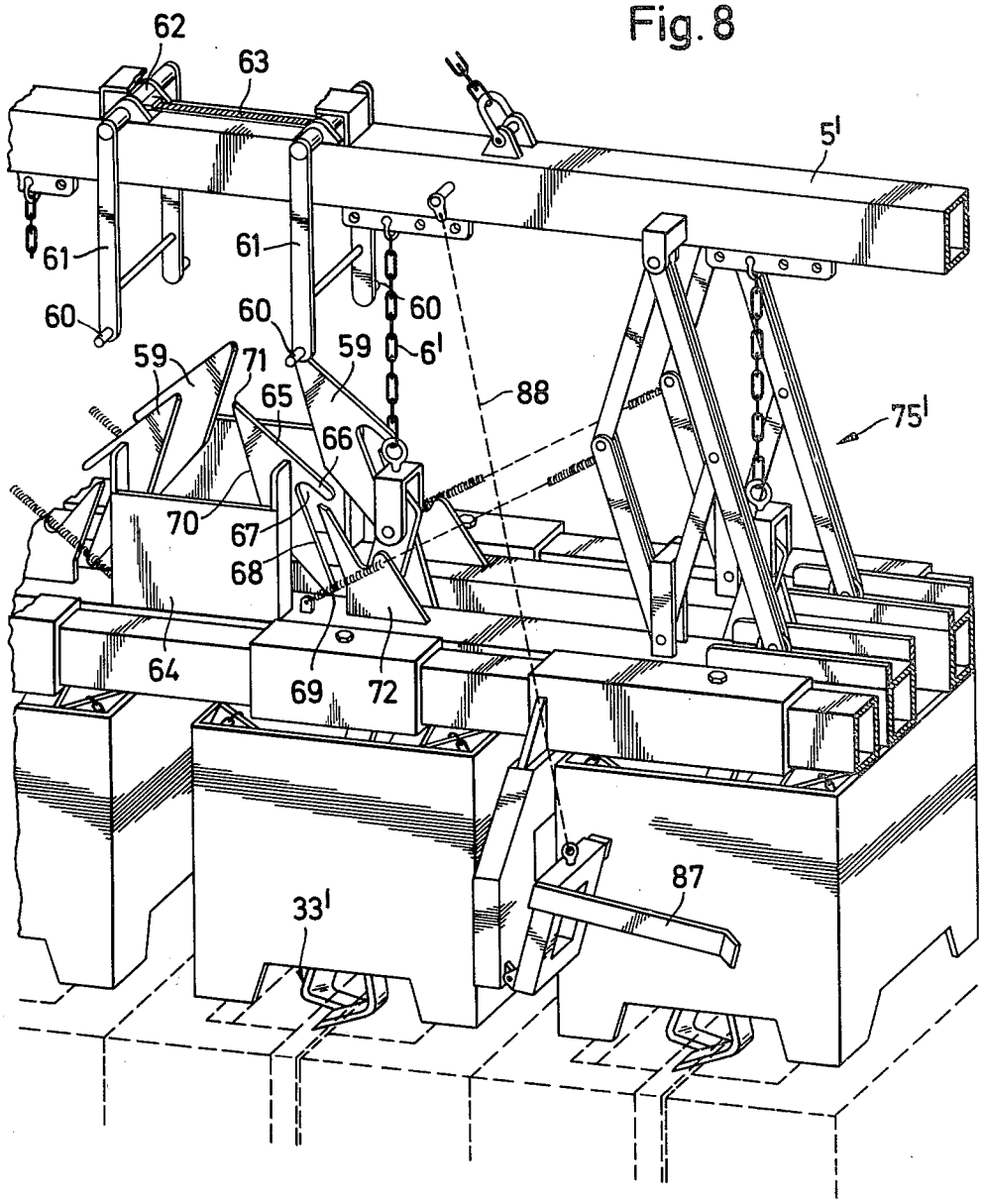
FIG. 8 is an enlarged perspective view showing only part of the apparatus with two gripping devices in their operative position.
Figure 9:
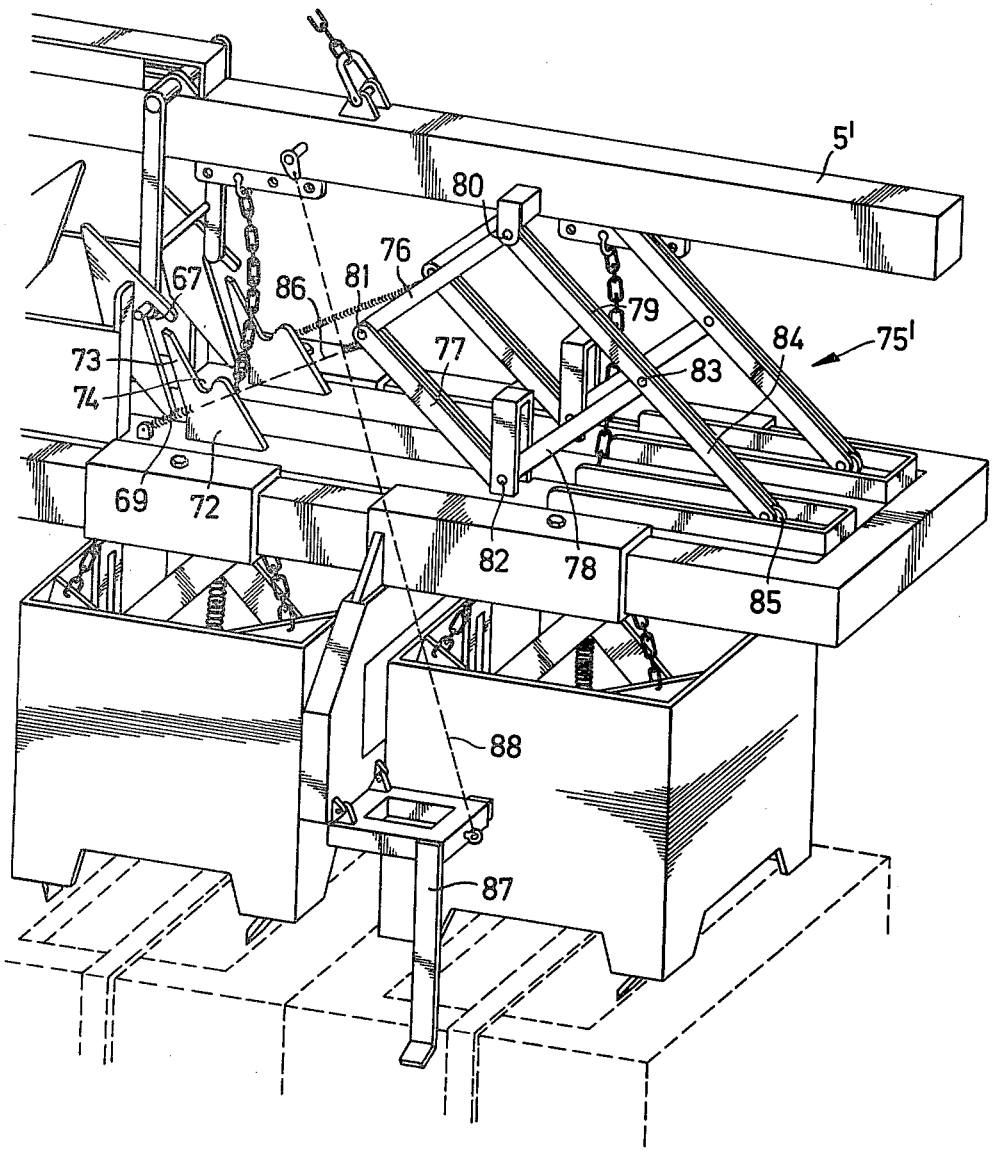
FIG. 9 is a similar perspective view illustrating the same gripping devices in their inoperative position.

FIGS. 7 to 9 show an alternative embodiment of the invention in which the adjustment of the first carrier between movable and secured conditions relative to the holders may be accomplished quicker and much more simple than in the embodiment described above. In FIGS. 7 to 9 the hoisting apparatus with the alternative control mechanism is generally designated 1'. 2'' designates pulp bales to be lifted by means of the apparatus. Like the apparatus of FIGS. 1 to 4 the present apparatus comprises a number of holders 4', a first carrier 5', a number of gripping devices 33' in the holders, a second carrier 7' which is connected to the holders 4' but not to the gripping devices and a number of pull members 6' which connect the first carrier 5' to the spring devices 33'.

The control mechanism forming the essence of this alternative embodiment is generally designated 58. This control mechanism comprises a number (four) of first locking members in the form of plates 59 and a corresponding number of second locking members in the form of pins 60 which extend substantially perpendicular to the planes of plates 59. These locking pins 60 are arranged in the lower end of arms 61 which are pivotally mounted on the carrier or bar 5'. The pivot arms 61 belong together in pairs and are arranged to hang down vertically from bar 5' by the action of gravity. Between the two shafts 62 on which the respective arm pairs are mounted a rubber band spring 63 extends for damping any pendulous motion of the arms 61. It should be noticed that the two arm pairs are spaced apart in the longitudinal direction of bar 5'.

As in the previous embodiment bar 5' is movable substantially vertically in relation to the holders 4' or the frame 7'. Hence the locking pins 60 describe a vertical path when moving towards and away from the locking plates 59 respectively.

Plates 59 are firmly attached to frame 7', more exactly on standard plates 64 fixed on the inner longitudinal beams 14', 15'. Each such plate 59 presents an inclined first guiding surface or cam 65 which faces upwards and is located right under the co-operating pin 60. This first guiding cam changes at the bottom portion thereof into a nose 66 which in turn delimits a downward seat 67 in which the pin 60 in question may be received. Further plate 59 presents a second guiding cam 68 extending downwardly from seat 67, said second guiding cam changing at a bottom point 69 into a third guiding cam which extends obliquely upwards from said bottom point 69 to an upper point 71 where the first-mentioned guiding cam 65 starts. An auxiliary guiding plate 72 (see FIG. 9) may suitably co-operate with each locking plate 59, said auxiliary guiding plate having a finger 73 which projects towards seat 67 as well as a second seat 74 opening upwards. As appears from FIG. 9 this second seat 74 is situated on a level under the first seat 67 but over the lower point of change 69 between the second and third guiding cams of plate 59 (cf FIG. 8).

The control mechanism thus described operates as follows:

In FIGS. 7 and 8 the apparatus is shown during lifting of the load. Here bar 5' is located as high as possible over frame 7', the pull members 6' being tensioned in order to accomplish the gripping of the bales by means of the gripping devices 33'. When the bales are to be released bar 5 is lowered, whereby the locking pins 60 contact the first guiding cam 65 of the respective plates 59. Each first guiding cam brings the pins aside so that these upon continued lowering finally will rest in the seats 74 of the auxiliary guiding plates 72. Bar 5' is now raised resulting in that the pins 60 are guided to the seats 67 in plates 59 because the arms 61 always aim, due to their own weight, at returning to the position in which they suspend vertically from the bar, the pins being, in their movement between the seats 74 and 67, guided by fingers 73 of the auxiliary guiding plates 72. As soon as pins 60 have reached seats 67 the bar is secured on a comparatively low level in relation to frame 7 and continued raising of bar 5 will bring about that the gripping devices 33′ release the bales 2″ in the manner previously described in connection with FIGS. 1 to 4.

When a new load is to be gripped bar 5′ is lowered so far that the pins 60, after having followed the second guiding cam 68, may pass the point of change 69. When this has taken place bar 5′ is once again lifted resulting in that the pins 60 will follow the third guiding cams 70 to the upper point 71 where the pins are freed from the contact with plates 59 so that the arms 61 may assume the unsecured positions shown in FIGS. 7 and 8. Thereby pull members 6′ are once again tensioned in order to actuate the gripping devices 33′ to grip the bales.

It is of great importance that the relative movement between the pins 60 and the guiding plates 59 (and accordingly the movement between carrier 5′ and frame 7′) always takes place in a vertical plane, because otherwise the appropriate co-operation between pins 60 and plates 59 would be jeopardized. To this end the invention conceives a retainer mechanism comprising two separate parallelogram arm systems 75, 75′. Each of these systems (see FIG. 9) comprises four arms 76, 77, 78, 79 which are pivotable relative to each other through pivots 80, 81, 82, 83. A first one 80 of these pivots is firmly attached to bar 5′, while an opposite second pivot 82 is firmly attached to frame 7′. In addition to the above-mentioned four arms 76 to 79 each system comprises a fifth arm 84 which in the embodiment shown is a rigid extension of the arm 79. This fifth arm 84 supports with the free end 85 thereof against frame 7′ and is arranged to compulsorily move parallel to arm 77 and accordingly compulsorily prevent any tendency to displacements of bar 5′ longitudinally in relation to frame 7′.

A spring 86 in each arm system is arranged to influence the system in such a manner that the two opposite fixed pivots 80, 82 aim at approaching each other. This guarantees that the arm system does not unintentionally provide any blocking effect between bar 5′ and frame 7′.

As appears from FIG. 7 two rods 87 are pivotally connected to a long side of frame 7′, said rods being connected to bar 5′ through chains, wires or similar flexible elements 88. When bar 5′ is secured relative to frame 7′ according to FIG. 9 these rods 87 projects substantially vertical from a part of frame 7′ to a certain level under the gripping devices 33′ in order to contact the bales 2″ as illustrated. Hereby these rods determine the position of the frame, and accordingly the whole apparatus, relative to the bales. When the bar 5′ is unsecured relative to frame 7′ (i.e. locking pins 60 run free of guiding plates 59) the chains 88 see to it that the rods 87 are rotated to the upturned position shown in FIG. 8 on a level over the bottom portions of holders 4′. In this position the rods are out of way when the load is put down adjacent to a load previously put down.

The advantages of the apparatus of the invention are evident, in that it operates automatically in gripping as well as releasing the load, both operations being extremely reliable. Further the apparatus is made of inexpensive mechanical components only.

Of course the invention is not merely limited to the embodiments shown in the drawings. Thus the expression "holder" should be understood in the widest sense and include each arbitrary element in relation to which the gripping device in question may be adjusted from an operative to an inoperative position. The holder may accordingly be a simple support for supporting the shaft when the apparatus is put down. Likewise the expression "gripping device" should be understood in the widest sense insofar as the invention may be applied to very simple gripping devices too, such as simple rotatable hooks for engaging e.g. an eye. Instead of just four or four pairs of gripping claws the apparatus may include one or more, up to an almost unlimited number of gripping claws. Further it is possible to unite two or more similar (or different) hoisting apparatus by interconnecting the first carriers 5 thereof by means of crossbeams of suitable type. Other types of control mechanisms having the same function as the mechanisms described are conceivable. Further it is possible to unite the second carrier 7 and the holders in question so as to form a single unit thereof. Of course the hoisting apparatus may be used in connection with any type of load adapted to be gripped thereof. In this connection it is possible to modify the gripping devise so that this will include a plurality of circularly arranged claws or jaws surrounding a spherical head of the like on the load in question. Accordingly the expression "shaft" should be understood in the widest sense and comprise all types of members which may form an axis around which the arm or arm-like part of the gripping device is rotatable. In the embodiment of FIGS. 7 to 9 it is possible to arrange the guiding plates 59 on the bar or the first carrier 5′, while the locking pins 60 are arranged on frame 7′. Irrespective of the localisation of the plates and pins respectively, the plates may be movable across the direction of the relative movement between the plates and the pins instead of the pins being movable as shown in the drawings. Further the pins may be laterally movable in another way than by being part of rotatable arms. Thus the pins may be movable in the longitudinal direction of the bar 5 against the action of springs of a suitable type. Also the plates 59 may be movable against the action of springs in an analogous manner. Instead of making the control mechanism of the invention act between the carrier 5′ and the frame 7′ it is, of course, also possible to make it act directly between the carrier 5′ and one or more holders for the gripping devices, thereby sparing a special frame.

What we claim is:

1. Hoisting apparatus of the type comprising at least one gripping device (33) associated with a holder (4), said gripping device being movable relative to the holder between an operative position and an inoperative position, and a carrier (5), which is movable relative to the holder (4) towards a position remote from the holder as well as securable—by means of a control mechanism—relative to the holder in a position closer thereto than the first-mentioned position, said carrier being connected to the gripping device (33) through at least one pull member (6) which in a tensioned condition—when the carrier is unsecured and movable relative to the holder—forces the gripping device to assume a first one of said two positions thereof and in a tensionless condition—when the carrier is unsecured relative to the holder—permits the gripping device to assume the second one of said two positions thereof, characterized in that the gripping device (33) comprises at least one arm (36) which is provided with a gripping claw (37) and rotatable between said operative position and said inoperative position about an axis (38) which is associated with the holder (4) through a connection (39, 40) permitting raising and lowering of said axis relative to the holder so as to locate the gripping claw (37) substantially on one and the same level at the bottom of the holder irrespective of whether the gripping claw is kept in the operative position by action of said pull member or is remote from said position.

2. Apparatus according to claim 1, characterized in that the axis (38) is disposed on a heavy cross-bar (39) the opposite ends of which are guided by upright guides (40) in the holder.

3. Apparatus according to claim 1, characterized in that the axis (38) supports two spaced-apart pairs (34, 35) of arms (36) which are connected to the pull member (6) through links (42), said pairs each having two opposite gripping claws (37) directed towards each other.

4. Apparatus according to claim 3, characterized in that a spring (44) is arranged between the pull member and the shaft (38) for bringing said shaft and said pull member closer to each other and thereby, through said links (42), rotate the arms (36) to separate the gripping claws (37) from each other.

5. Apparatus according to claim 1, characterized in that the control mechanism (58) comprises two interacting locking members (59, 60), at least one of which is movable relative to the other and a first one (59) of which presents a guiding cam (65) which is inclined in relation to the direction of said relative movement of the locking members as well as a seat (67) for receiving the second locking member (60), said seat being disposed on that side of said first locking member which is opposed to said guiding cam, and that at least one locking member (60) is movable across said direction of relative movement and tends to return to a position in which the relative movement brings about that the guiding cam of the first locking member may contact the second locking member, this second locking member being—against the above-mentioned tendency of returning—forced to follow the guiding cam (65) and be guided to the seat (67) of the first locking member in order to engage said seat, thereby effectuating the locking of the carrier (5') on said first level over the holder.

6. Apparatus according to claim 5, characterized in that the first locking member is a plate (59) while the second locking member is a pin (60) extending substantially perpendicularly to the plane of the plate.

7. Apparatus according to claim 6, characterized in that the locking pin (60) is disposed on an arm (61) which is rotatable relative to the carrier (5') and that said arm is arranged to aim at assuming a position in which it suspends from the carrier and in which the locking pin is located substantially vertically above the inclined guiding cam (65) of the first locking member (59).

8. Apparatus according to claim 5, characterized in that a mechanism (75, 75') operating between the carrier (5') and a device (7'), such as a frame, associated with the holder, is arranged to guide the carrier in a substantially vertical plane above said device and thereby guide the two locking members (50, 60) in a substantially vertical plane in relation to each other.

9. Apparatus according to claim 1, characterized in that the holder or holders (4) are connected to a second carrier (7) which has the control mechanism (9, 9') for effectuating the function of holding on a first occasion the first carrier (5) on a first level over the holder (4), where the pull member (6) is tensionless, and on a second occasion release the same in order to move it to a second, higher level over the holder, where the pull member (6) is tensioned.

10. Apparatus according to claim 9, characterized in that the second carrier is in the form of a frame (7, 7') and that a rod (87) which is pivotally connected to the frame along a long side thereof is connected to the first carrier (5') through a flexible element (88), said rod projecting substantially vertical from the frame to a level under the gripping devices when the first carrier (5') is locked relative to the frame so as to abut the load in question and hereby derermine the position of the frame in relation to the load, said flexible element being arranged to rotate the rod to an upper position on a level over the bottom of the holder when the carrier is released from the frame.

11. Hoisting apparatus comprising at least one gripping device associated with a holder, said gripping device being movable between an operative position and an inoperative position, and a carrier which is movable relative to said holder as well as securable in a certain position relative to said holder, said carrier being connected to said gripping device through at least one pull member which in a tensioned condition—when said carrier is movable relative to said holder on a certain comparatively high level over said holder—forces said gripping device to assume a first one of said two positions and in a tensionless condition—when said carrier is secured on a lower level relative to said holder—permits said gripping device to assume the second one of said two positions, a switching mechanism for effecting the alternate switching of said carrier between said movable and secured positions relative to said holder, said switching mechanism comprising first and second interacting locking members at least one of which is movable relative to the other, characterized in that said first locking member (59) has an inclined guiding cam (65) which is inclined in relation to the direction of said relative movement of said locking members and a seat (67) for receiving said second locking member (60), said seat being disposed on that side of said guiding cam which is opposed to said first locking member, and that at least one of said locking members is movable across said direction of relative movement and always tends to return to a neutral position in which the relative movement brings about that said guiding cam of said first locking member may contact the second locking member, said second locking member being—against the above-mentioned tendency of returning—forced to follow said guiding cam and be guided to said seat of said first locking member in order to engage said seat, thereby effectuating the locking of said carrier on said lower level over said holder.

12. Apparatus according to claim 11, characterized in that said first locking member is a plate (59) while said second locking member is a pin (60) which extends substantially perpendicularly to the plane of said plate and is disposed on a rotable arm (61) which is rotatable relative to said carrier, and that said arm is arranged to aim at assuming a position in which it suspends from said carrier and in which said locking pin is located substantially vertically above said inclined guiding cam.

13. Apparatus according to claim 12, wherein damping means (63) are associated with said rotatable arm (61) for quickly damping possible pendulous motion of said rotatable arm.

14. Apparatus according to claim 12, wherein said carrier is long and has at least one pair of said first and second locking members which are spaced apart along said carrier and each of said second locking members co-operates with one of said first locking members.

15. Apparatus according to claim 12, wherein said plate (59) is a locking guide plate and in addition to said first mentioned guiding cam (65) comprises a second guiding cam (68) extending downwardly from said seat (67), said second guiding cam, at a bottom point, being changed into a third guiding cam which extends obliquely upwards from said bottom point to an upper point (71) where said first mentioned guiding cam (65) starts.

16. Apparatus according to claim 15, wherein an auxiliary guide plate (72) is arranged beside said locking guide plate, said auxiliary guide plate having a finger (73) which projects towards said seat (67) as well as a second seat (74) opening upwards, said second seat being situated on a level between said first mentioned seat (67) and the bottom point of change (69) between said second and third guiding cams (68, 70).

17. Apparatus according to claim 11, wherein a mechanism (75, 75') operating between said carrier and a device (7'), such as a frame associated with said holder, is arranged to guide said carrier in a substantially vertical plane above said device and thereby guide said first and second locking members (59, 60) in a substantially vertical plane in relation to each other.

18. Apparatus according to claim 11, wherein said gripping device (33, 33') includes at least one arm (36) which is provided with a gripping claw (37) and rotatable between said operative position and said inoperative position about an axis (38) which is associated with said holder through a connection (39,40) permitting raising and lowering of said axis relative to said holder so as to locate said gripping claw (37) substantially on one and the same level at the bottom of said holder irrespective of whether said gripping claw is kept in the operative position by action of said pull member or is remote from said position.

* * * * *